US005943955A

United States Patent [19]

Niemiro et al.

[11] Patent Number: 5,943,955

[45] Date of Patent: Aug. 31, 1999

[54] PRINTING PRESS HAVING CANTILEVERED SELF-DRIVEN CYLINDERS

[75] Inventors: Thaddeus A. Niemiro, Lisle; Thomas W. Orzechowski, Orland Park; Radoslaw Kulesza, Westmont, all of Ill.

[73] Assignee: Goss Graphic Systems, Inc., Westmont, Ill.

[21] Appl. No.: 08/920,462

[22] Filed: Aug. 29, 1997

[51] Int. Cl.[6] ..... B41F 13/10

[52] U.S. Cl. ..... 101/216; 101/375

[58] Field of Search ..... 101/152, 153, 101/216, 247, 375, 376, 378, 382.1, 383, 389.1, 218, 219, 477

[56] References Cited

U.S. PATENT DOCUMENTS

| | | | |
|---|---|---|---|
| Re. 33,944 | 6/1992 | Knauer . | |
| Re. 34,970 | 6/1995 | Tittgemeyer . | |
| 1,134,697 | 4/1915 | Pervilhac . | |
| 3,003,417 | 10/1961 | Englander . | |
| 3,129,662 | 4/1964 | Pinkerton . | |
| 3,789,757 | 2/1974 | Motter et al. . | |
| 4,111,120 | 9/1978 | Paulson . | |
| 4,477,954 | 10/1984 | Molinatto . | |
| 4,697,516 | 10/1987 | Rombout . | |
| 4,807,527 | 2/1989 | Knauer . | |
| 4,876,958 | 10/1989 | Townsend . | |
| 4,901,641 | 2/1990 | Steiner et al. . | |
| 4,913,048 | 4/1990 | Tittgemeyer . | |
| 4,932,322 | 6/1990 | Keller . | |
| 4,934,264 | 6/1990 | Gansky et al. . | |
| 4,967,658 | 11/1990 | Townsend . | |
| 4,991,503 | 2/1991 | Morner . | |
| 5,092,240 | 3/1992 | Schumacher . | |
| 5,101,726 | 4/1992 | Lübke et al. . | |
| 5,188,027 | 2/1993 | Fantoni . | |
| 5,237,920 | 8/1993 | Guaraldi . | |
| 5,241,905 | 9/1993 | Guaraldi et al. . | |
| 5,392,709 | 2/1995 | Seyffert et al. . | |
| 5,394,797 | 3/1995 | Döbler et al. . | |
| 5,458,061 | 10/1995 | Koura et al. . | |
| 5,481,972 | 1/1996 | Schmid . | |
| 5,505,127 | 4/1996 | Knauer . | |
| 5,711,222 | 1/1998 | Taylor et al. | 101/383 |
| 5,787,808 | 8/1998 | Stram et al. | 101/153 |

FOREIGN PATENT DOCUMENTS

| | | |
|---|---|---|
| 0 406 694 A2 | 1/1991 | European Pat. Off. . |
| 0 782 919 A1 | 7/1997 | European Pat. Off. . |
| 470947 | 2/1929 | Germany . |
| 195 15 459 A1 | 10/1996 | Germany . |
| 607 760 | 10/1978 | Switzerland . |

*Primary Examiner*—Ren Yan

*Attorney, Agent, or Firm*—Marshall, O'Toole, Gerstein, Murray & Borun

[57] ABSTRACT

In order to facilitate removal and replacement of blanket and impression sleeves in a rotary offset printing press, the blanket and plate cylinders are supported in cantilever fashion. The cantilevered cylinders allow axial removal and replacement of the blanket and impression sleeves without temporary support of the cylinder and without removal of any bearings. Each cylinder is rotatably supported on a cantilevered support shaft having a bore therethrough. A drive shaft operatively connected to a drive motor extends through the support shaft bore and engages the inner surface of the generally hollow cylinder. A blanket or impression sleeve mounted on the cylinder is removable using compressed air, which is routed through a bore in the drive shaft and through a plurality of radially oriented passage in a flange on the end of the drive shaft. Each radial passage communicates air to an exit port on the surface of the cylinder, which introduces enough air between the cylinder and the sleeve to permit the sleeve to slide freely for axial removal and replacement.

38 Claims, 3 Drawing Sheets

PRINTING PRESS HAVING CANTILEVERED SELF-DRIVEN CYLINDERS

FIELD OF THE INVENTION

The present invention relates generally to a rotary offset printing press having removable impression and blanket sleeves mounted on axially rotatable plate and blanket cylinders, respectively. More specifically, the present invention relates to cantilevered self-driven cylinders for rotary presses which permit the axial removal and replacement of the sleeves, and which improve print quality, reduce downtime, and minimize drive line related problems.

BACKGROUND OF THE INVENTION

Rotary offset printing presses having rotatable cylinders and removable impression and blanket sleeves are generally well known in the art. Such presses typically operate at very high speeds and are capable of printing a high quantity of material in a relatively short period of time. A continuous web of paper passes between a pair of rotating blanket cylinders which print images on opposites sides of the paper web. Each blanket cylinder is in contact with a plate cylinder having an impression sleeve which has been inked and dampened and which transfers the images to the blanket cylinder for printing onto the web in a manner well known in the art.

In order to change the printed material, such as when a newspaper, magazine or brochure is switched to a different edition, the plate cylinder is moved away from its adjacent blanket cylinder, the impression sleeve on the plate cylinder is removed, and a different impression sleeve is installed. When the changeover process is complete the press is ready for the next printing run.

Many times, such changeovers occur with great frequency, such as when small jobs are being printed. Unfortunately, the process of changing the impression sleeve is very labor intensive and time consuming, and thus there is considerable down time for the press. Typically, each cylinder in the press is mounted for axial rotation between a pair of spaced apart side walls. The impression sleeves are mounted to the cylinders, and fit so snugly that the sleeves are held in place by friction. In order to move the sleeve relative to the cylinder, compressed air is forced between the inner surface of the sleeve and the outer surface of the supporting cylinder. The cushion of air expands the sleeve slightly, and allows the sleeve to slide relative to the cylinder. Thus, in order to install or remove the impression sleeve from the plate cylinder, the plate cylinder must first be disconnected and removed from the side walls. Thereafter, a new impression sleeve is placed on the cylinder in the same manner and the rotatable cylinder is reinstalled in preparation for the next printing run. As outlined above, this is a very time consuming process and seriously undermines the cost effectiveness of the press when the press is being used on relatively small jobs.

A number of approaches have been attempted in order to decrease the changeover time between printing runs. For example, one approach as disclosed in U.S. Pat. No. 4,807,527 is to provide a releasable bearing on one end of the cylinder shaft. Removal of the bearing assembly creates an access hole in the press side wall and exposes one end of the cylinder shaft so that the impression sleeve can slide off the shaft through the access hole. The other end of the shaft is elongated, and during the changeover process the elongated portion of the shaft abuts an auxiliary shaft which is put in place for temporary support.

Similarly, U.S. Pat. No. Re. 34,970 discloses a pivotable bearing which swings away to free up one end of the cylinder for the removal of the sleeve, and also discloses a cylinder supported by a pair of linearly retractable bearings, and finally a cylinder mounted to a swivel on one end and having a retractable bearing on the other.

Unfortunately, in addition to other shortcomings, each of the prior art devices requires some means of temporary cylinder support in order to effectuate the changeover of the impression sleeve. In addition, each of the prior art devices requires that at least one of the bearing assemblies be completely disconnected from the cylinder shaft, and thus, neither of these approaches provides a cost effective solution to the problems outlined above.

Another problem with prior art printing presses is that all of the rotating cylinders in the machine are mechanically connected to a single drive shaft system, which creates a number of inherent drawbacks. For example, all of the rotating cylinders and rollers in a printing press are typically connected to a common drive system, which consist of an extensive collection of drive shafts, gearboxes and pulleys, all of which is designed to spin all of the cylinders in the press at the same peripheral speed. Because all of the cylinders must have access to the same drive system, the placement of the cylinders relative to each other is severely constrained, which adds to the difficulty in changing impression sleeves on the plate cylinders. Moreover, on large presses there is noticeable lash in the drive system, which causes registration and vibration problems, both of which negatively impact print quality.

Accordingly, there exists a need for a rotary offset printing press having cantilevered cylinders which permit fast replacement of the impression sleeve and which do not require temporary support during changeover. There also exists a need for self-driven cylinders which reduce or eliminate drive line lash and which also improve registration and overall system performance.

SUMMARY OF THE INVENTION

The present invention uses generally hollow cylinders mounted on cantilevered support shafts. The cantilevered construction completely eliminates much of the componentry normally required at one of the cylinder ends, and thus access to the cylinder for removal or replacement of the impression sleeve is greatly improved. During changeover no bearings must be disconnected and no temporary support is required and thus changeover times are dramatically reduced.

The present cantilevered construction also makes possible a self-driven feature for the cylinders in which each cylinder has its own drive motor. Preferably, the drive motors are synchronized using servo-controllers, and thus registration is simplified, print abnormalities induced by conventional drive system harmonics are reduced, and drive system lash is eliminated. Moreover, because the cylinders need not be removed from the supporting structure during changeover, the drive system never needs to be disconnected. Finally, the placement of the plate and blanket cylinders is not constrained by the requirements of the drive system, and thus, the present invention offers much more flexibility in the placement of printing couples in both new and retrofitted presses.

The present invention also incorporates a pair of rotatable adjustment members which enable the angle of the support shafts and their attached cylinders relative to the supporting frame to be precisely controlled. The adjustment members are tapered, and may be manipulated to vary the bias angle between zero bias and a maximum bias. The adjustable bias angle thus ensures that the blanket cylinders and the plate cylinders will have a uniform contact pressure along there entire length, which greatly improves print quality.

Accordingly, it is an object of this invention to provide an improved rotary offset printing press.

It is another object of this invention to provide a rotary printing press having cantilevered cylinders which greatly reduce changeover time.

A further object of this invention is to provide self-driven cylinders which improve system performance and which eliminate drive line lash.

A still further object of the invention is to provide blanket cylinders and plate cylinders having adjustable bias angles.

These and other objects of the invention will become readily apparent to those skilled in the art upon a reading of the following description with reference to the accompanying drawings.

DETAILED DESCRIPTION OF THE PREFERRED EMBODIMENT

The embodiments described herein are not intended to be exhaustive or to limit the invention to the precise form disclosed. They have been chosen and described in order to best explain the principles of the invention and its practical use in order to enable others skilled in the art to follow its teachings.

Figure 1:
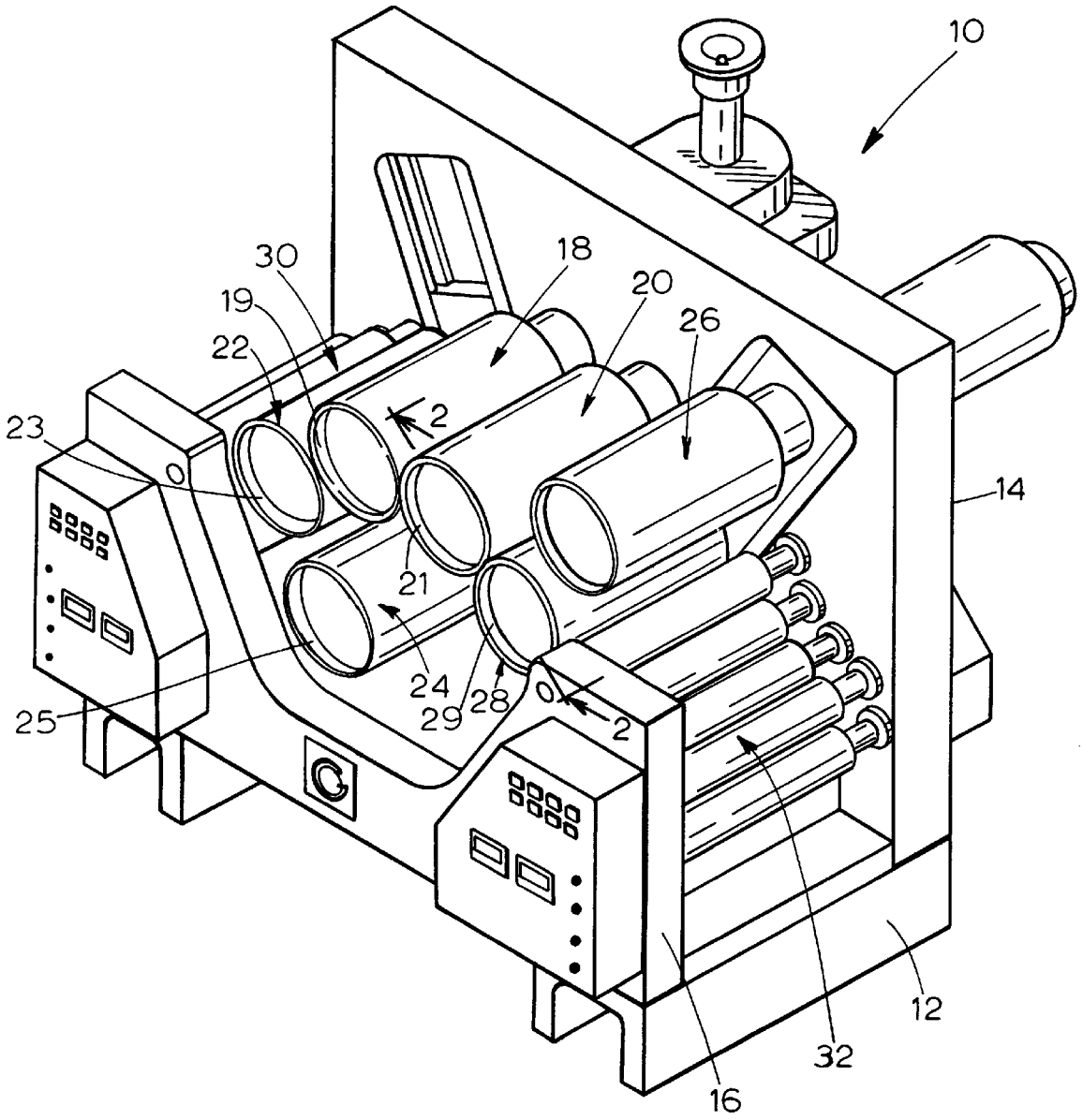
FIG. 1 is a perspective view of a rotary offset printing press incorporating the cantilevered, self-driven cylinders of the present invention shown in combination with several more conventional cylinders.

Referring now to the drawings, FIG. 1 illustrates a rotary offset printing press incorporating the features of the present invention and which is generally referred to by the reference numeral 10. Press 10 includes a frame 12 and a pair of opposing side walls 14, 16. Press 10 also includes a pair of blanket cylinder assemblies 18, 20 between which passes a web of paper (not shown) to be printed. Each of the blanket cylinder assemblies 18, 20 is disposed adjacent a pair of plate cylinder assemblies 22, 24 and 26, 28, respectively. Blanket cylinder assemblies 18, 20 each support a generally hollow rotatable blanket cylinder 19, 21, respectively, and plate cylinder assemblies 22, 24, and 26, 28 each support a generally hollow rotatable plate cylinder 23, 25, and 27, 29, respectively, in a manner which will be explained in greater detail below. Preferably, plate cylinder assemblies 22, 24 are interchangeable, i.e., one or the other can be used for printing at any given time, as are plate cylinder assemblies 26, 28. Consequently, blanket cylinder assemblies 18, 20 are in contact with only one of their adjacent plate cylinder assemblies 22, 24 or 26, 28 during operation of the press 10. Each of blanket cylinder assemblies 18, 20 and plate cylinder assemblies 22, 24 and 26, 28 are mounted in cantilever fashion to side wall 14 in a manner which will be discussed in greater detail below.

Press 10 also includes a pair of ink roller assemblies 30, 32, each of which includes a plurality of individual inking rollers. Ink roller assemblies 30, 32 apply ink and/or a dampening solution to their adjacent plate cylinders 22, 24 and 26, 28 respectively, in a manner well known in the art. Ink roller assemblies 30, 32 are rotatably mounted between side walls 14, 16 in a conventional manner.

Figure 2:
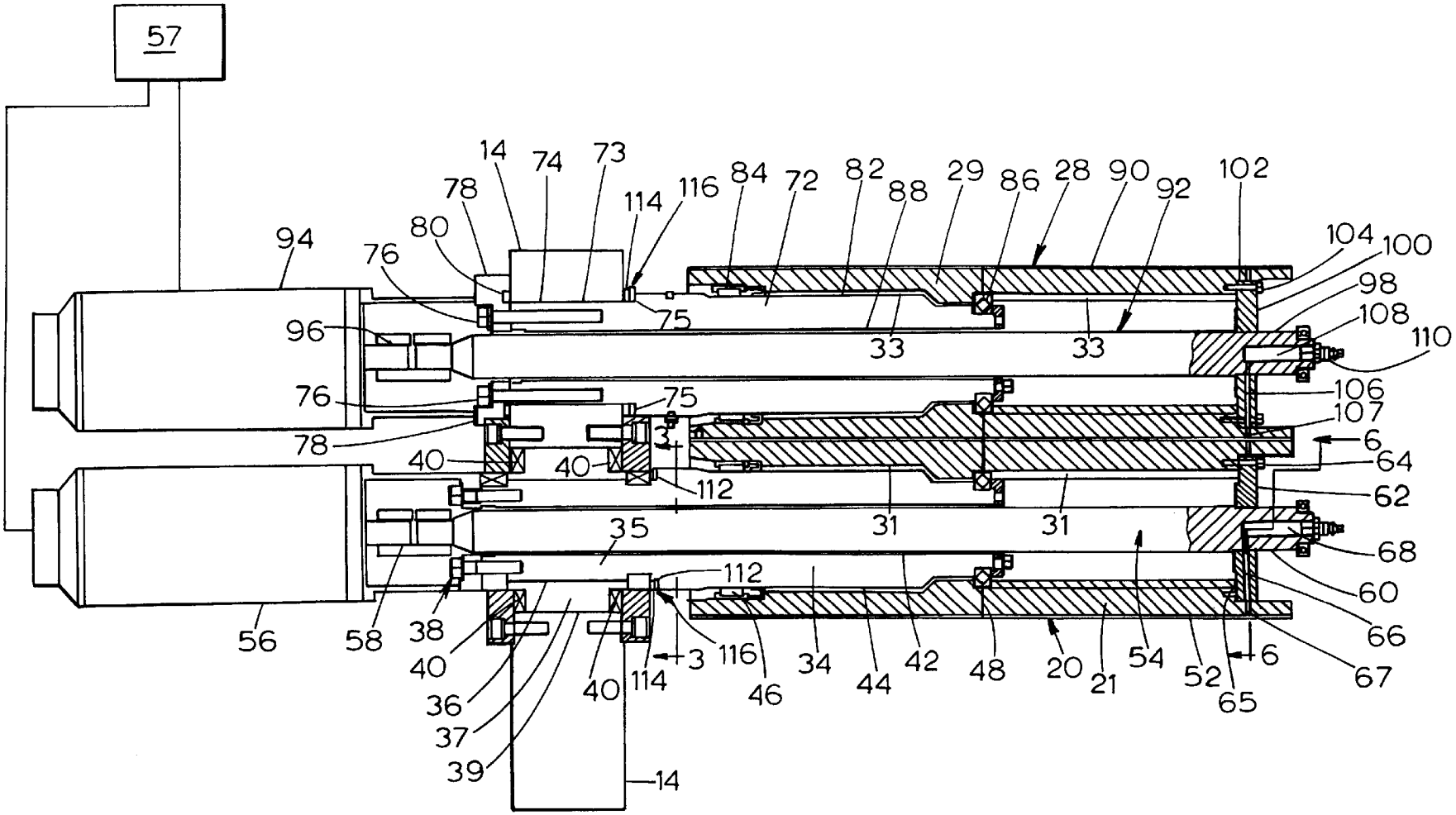
FIG. 2 is an enlarged cross-sectional view taken along lines 2—2 of FIG. 1 and showing a blanket cylinder and plate cylinder unit incorporating the cantilevered, self-driven features of the present invention.

Referring now to FIG. 2, blanket cylinder assembly 20 and plate cylinder assembly 28 are shown mounted in side-by-side cantilever fashion to side wall 14. It will be understood that the structure, function and operation of blanket cylinder assembly 18 and its adjacent plate cylinder assemblies 22, 24 is substantially the same as the structure, function and operation of cylinder assemblies 20 and 28 shown in FIG. 2. Similarly, the structure, function and operation of plate cylinder assembly 26 is substantially the same as plate cylinder assembly 28. Accordingly, only blanket cylinder assembly 20 and plate cylinder assembly 28 will be described in detail.

Blanket cylinder assembly 20 includes a support shaft 34 having a cylindrical base 35 which extends through a bore 36 in a carriage 37. Support shaft 34 also includes a shoulder 112 which abuts a pair of adjustment members 114, 116, which are used to alter the angle of support shaft 34 relative to side wall 14 as is explained in greater detail below. Support shaft 34 is rigidly secured to carriage 37 by a plurality of mounting bolts 38. Carriage 37 is slidably mounted in a slot 39 in side wall 14, and is supported for linear movement within slot 39 on a plurality of linear bearing sets 40. Carriage 37 thus permits the blanket cylinder assembly 20 to slide along a path perpendicular to the axis of support shaft 34. Support shaft 34 includes a generally cylindrical outer surface 44 and an inboard set of bearings 46 and an outboard set of bearings 48 which rotatably support the blanket cylinder 21. Support shaft 34 also includes a central longitudinal bore 42, the purpose of which is discussed in greater detail below. Blanket cylinder 21 includes an internal cavity 31, which is sized to fit over support shaft 34. A removable cylindrical blanket sleeve 52 fits over the outer surface of blanket cylinder 21 and is held in place by friction.

Figure 6:
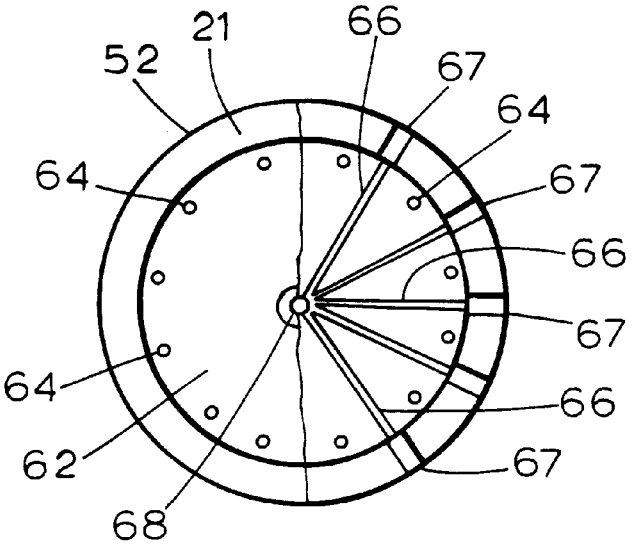
FIG. 6 is an enlarged end view, partly in section, of the end of the blanket cylinder shown in FIG. 2 (the end of the plate cylinder being identical) and illustrating the air passage in the drive shaft flange which communicates pressurized air to the exit ports on the cylinder outer surface to facilitate removal of the blanket sleeve.

A drive shaft 54 extends through bore 42 of support shaft 34 and is operatively connected to a drive motor 56 by a splined coupling 58. Drive motor 56 is preferably connected to a commercially available servo-controller 57, which permits the rotational orientation of the cylinder 21 to be controlled. Drive shaft 54 includes an outer end 60 having a circular mounting flange 62 which is mounted to an annular seat 65 on the inner surface of cylinder 21 by a plurality of mounting bolts 64 spaced circumferentially about the flange 62. As can be seen in FIGS. 2 and 6, flange 62 also includes a plurality of radially extending bores 66 which are aligned with a plurality of circumferentially spaced exit ports 67 through the outer surface of the blanket cylinder 21. Outer end 60 of drive shaft 54 also includes a bore 68 which intersects each of the plurality of radial bores 66. An air fitting 70 is affixed to the end 60 of drive shaft 54, which permits compressed air from a supply source (not shown) to be routed through ports 67 via bore 68 and radial bores 66, in order to permit the removal of sleeve 52 from blanket cylinder 21 in a manner commonly employed in the art. Moreover, because the blanket cylinder 21 is supported in true cantilever fashion, the sleeve 52 can be removed from blanket cylinder 21 without disconnecting bearing assemblies or providing temporary support since there is no interference from side wall 16 or from the drive system.

Referring now to the plate cylinder assembly 28, which is shown on the top when viewing FIG. 2, it includes a support shaft 72 having an eccentric base 73 which extends through a bore 74 in side wall 14. Support shaft 72 also includes a shoulder 75 which abuts a pair of adjustment members 114, 116, which are used to alter the angle of support shaft 72 relative to side wall 14 as is explained in greater detail below. Support shaft 72 is secured to side wall 14 by a plurality of mounting bolts 76, thrust washer 78, and thrust bearings 80. Thrush washer 78 and thrust bearings 80 permit the rotation of support shaft 72 about its eccentric base 73 using a throw off lever (not shown) in order to move plate cylinder assembly 28 towards or away from blanket cylinder assembly 20 during changeover, maintenance, or adjustments of press 10.

Support shaft 72 includes a generally cylindrical outer surface 82 and an inboard set of bearings 84 and an outboard set of bearings 86 which rotatably support the plate cylinder 29. Support shaft 72 also includes a central longitudinal bore 88. A removable cylindrical plate or impression sleeve 90 fits over the outer surface of plate cylinder 29 and is held in place by friction. Plate cylinder 29 includes an internal cavity 33, which is sized to fit over support shaft 72. A drive shaft 92 extends through bore 88 of support shaft 72 and is operatively connected to a drive motor 94 by a splined coupling 96. Drive motor 94 is also connected to servo-controller 57. Drive shaft 92 includes an outer end 98 having a circular mounting flange 100 which is mounted to an annular seat 102 on the inner surface of cylinder 29 by a plurality of mounting bolts 104 spaced circumferentially about the flange 100. Flange 100 also includes a plurality of radially extending bores 106 which are aligned with a plurality of circumferentially spaced exit ports 107 through the outer surface of plate cylinder 29. Outer end 98 of drive shaft 92 also includes a bore 108 which intersects each of the plurality of radial bores 106. An air fitting 110 is affixed to the end 98 of drive shaft 92, which permits compressed air from a supply source (not shown) to be routed through ports 107 via bore 108 and radial bores 106, in order to permit the removal of plate or impression sleeve 90 from cylinder 29 in a manner commonly employed in the art. As with the blanket cylinder 21, because the plate cylinder 29 is supported in true cantilever fashion, the removal of impression sleeve 90 can be accomplished without disconnecting bearing assemblies or providing temporary support since there is no interference from side wall 16 or the drive system.

Figure 3:
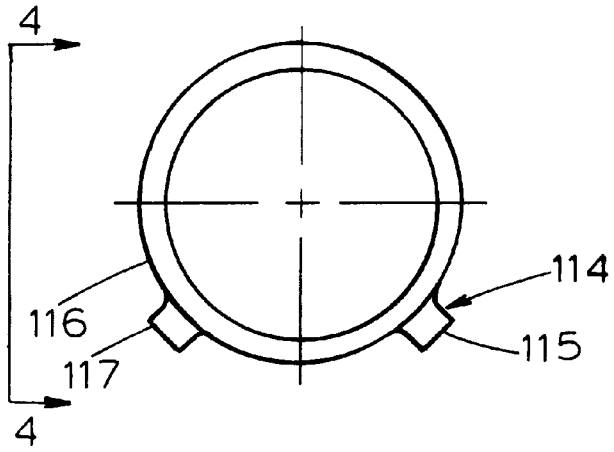
FIG. 3 is a fragmentary cross-sectional view taken substantially along lines 3—3 of FIG. 2.
Figure 4:
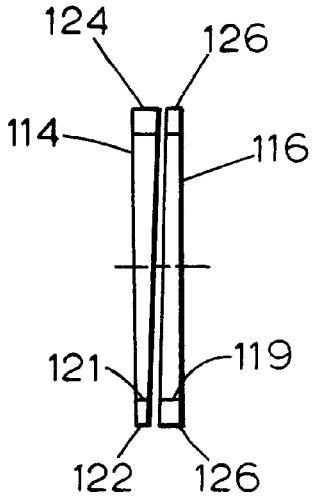
FIG. 4 is a side elevational view taken along lines 4—4 of FIG. 3 illustrating the tapered adjustment washers positioned for a zero bias angle.
Figure 5:
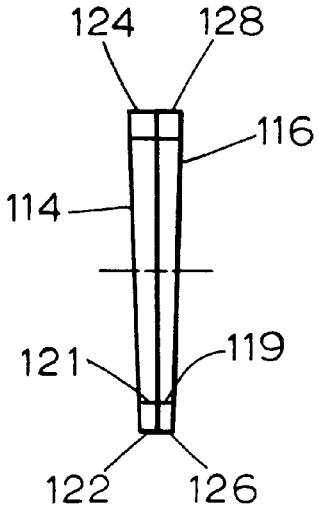
FIG. 5 is a side elevational view similar to FIG. 4 but illustrating the tapered washers adjusted for a maximum bias angle.

Referring now to FIGS. 3 through 5, adjustment members 114, 116 each include a tab or handle 115, 117 and a central bore 119, 121, respectively, which is sized to fit over the base 35 or 73 of their corresponding support shafts 34 or 72. As shown in FIGS. 4 and 5, adjustment member 114 includes a narrowed portion 122 and a thickened portion 124, while adjustment member 116 includes a narrowed portion 126 and a thickened portion 128. As can be seen in FIG. 2, a set of adjustment members 114, 116 is disposed about each of the bases 35 and 73 of shafts 34 and 72 in abutment with the shoulders 112, 75, respectively. Moreover, the adjustment members 114, 116 are wedged between the shoulders 112 and 75 of the support shafts 34 and 72 and the carriage 37 and side wall 14, respectively.

In operation, the support shaft 34 is mounted to carriage 37 with the adjustment members 114, 116 abutting the shoulder 112 adjacent the base 35. The members 114, 116 are rotated to the position shown in FIG. 4 to achieve a zero bias angle, or to the position shown in FIG. 5 to achieve a maximum bias angle. Alternatively, the adjustment members 114, 116 may be positioned in a plurality of intermediate positions. When the shaft 34 is secured to the carriage 37 using mounting bolts 38, the wedging action of the adjustment members 114, 116, when adjusted to achieve a desired bias angle, effectively bends the shaft 34 slightly. Thus, and by similarly using the adjustment members 114, 116 associated with the support shaft 72, the ends of the respective cylinder assemblies 20, 28 may be brought closer together or moved farther apart, in order to achieve a generally uniform contact pressure along the lengths of the cylinder assemblies 20 and 28.

Blanket cylinder 21 is mounted on stationary support shaft 34 on the bearing assemblies 46 and 48, and the drive shaft 54 is inserted through bore 42, with flange 62 being secured to the annular seat 65 by bolts 64. Drive motor 56 is mounted to carriage 37 in a conventional manner and operatively connected to drive shaft 54 via splined coupling 58. Similarly, plate cylinder 29 is mounted on stationary support shaft 72 on the bearing assemblies 84 and 86, and the drive shaft 92 is inserted through bore 88, with flange 100 being secured to the annular seat 102 by bolts 104. Drive motor 94 is mounted to eccentric base 73 of shaft 72 in a conventional manner and is operatively connected to drive shaft 92 via splined coupling 96. Finally, servo-controller 57 facilitates the proper registration of cylinder 21 relative to cylinder 29, and also ensures that the cylinders 21, 29 remain synchronized and spin at the same peripheral speed.

It will be understood that the above description does not limit the invention to the above-given details. It is contemplated that various modifications and substitutions can be made without departing from the spirit and scope of the following claims.

What is claimed:

1. An offset printing device comprising:

a frame;

a support shaft having a fixed end attached to said frame and a cantilevered portion extending away from said frame;

a hollow cylinder having an internal cavity, said cylinder being rotatably mounted about said support shaft cantilevered portion; and a sleeve circumferentially mounted about said cylinder for common rotation with said cylinder, said sleeve having impressions thereon for imparting printed images to a carrier material, said sleeve being axially removable from said cylinder.

2. The device as claimed in claim 1, wherein said cylinder includes an internal driven portion disposed within said cavity, and further including a drive motor engaging said driven portion.

3. The device as claimed in claim 2, wherein said support shaft includes a drive passage extending axially therethrough, and further including a drive shaft extending though said passage, said drive shaft including an outboard end engaging said driven portion.

4. The device as claimed in claim 3, wherein said drive shaft outboard end includes a flange.

5. The device as claimed in claim 4, wherein said flange includes a plurality of radially extending passages and said cylinder includes an outer surface having a plurality of circumferentially spaced ports, each of said flange passages being in alignment with an adjacent one of said ports, and an axial bore extending through a portion of said shaft and being in flow communication with said flange passages, thereby permitting axial movement of said sleeve relative to said cylinder upon the introduction of compressed air into said bore.

6. The device as claimed in claim 3, wherein said drive shaft outboard end includes an air passage extending axially therethrough and said cylinder includes an outer surface having a plurality of circumferentially spaced air ports, each of said ports being in flow communication with said air passage, thereby permitting axial movement of said sleeve relative to said cylinder upon the introduction of compressed air through said ports.

7. The device as claimed in claim 3, wherein said drive shaft includes an inboard end coupled to said drive motor.

8. The device as claimed in claim 7, wherein said drive shaft inboard end is coupled to said drive motor by a splined coupling.

9. The device as claimed in claim 1, wherein said frame includes a slot and further including a carriage slidably disposed within said slot, said support shaft being mounted to said carriage, thereby permitting said support shaft to move in a direction generally perpendicular to the longitudinal axis of said support shaft.

10. The device as claimed in claim 1, wherein said support shaft includes an eccentric base and said frame includes a bore, said support shaft being moveable in a direction generally perpendicular to its longitudinal axis upon rotation of said eccentric base within said bore.

11. An offset printing device comprising:

a frame;

a support shaft having a fixed end attached to said frame and a cantilevered portion extending away from said frame;

a hollow cylinder having an internal cavity, said cylinder being rotatably mounted about said support shaft cantilevered portion;

an impression sleeve circumferentially mounted about said cylinder for common rotation with said cylinder, said sleeve being axially removable from said cylinder; and a drive motor for rotating said cylinder, said drive motor being mounted to said frame and engaging said cylinder from within said internal cavity.

12. The device as claimed in claim 11, wherein said frame includes at least one side, said support shaft extending in one direction from said side, and said drive motor extending in the other direction from said side.

13. The device as claimed in claim 12, wherein said cylinder internal cavity includes a driven portion and said support shaft includes an axial bore, and further including a drive shaft extending though said axial bore and having a first end engaging said drive motor and further having an outboard end engaging said driven portion.

14. The device as claimed in claim 13, wherein said drive shaft outboard end includes a flange.

15. The device as claimed in claim 14, wherein said drive shaft outboard end includes an air passage extending axially therethrough and said cylinder includes an outer surface having a plurality of circumferentially spaced ports, each of said ports being in flow communication with said air passage, thereby permitting axial movement of said sleeve relative to said cylinder upon the introduction of compressed air through said ports.

16. The device as claimed in claim 14, wherein said flange includes a plurality of radially extending passages and said cylinder includes an outer surface having a plurality of circumferentially spaced ports, each of said flange passages being in alignment with an adjacent one of said ports, and an axial bore extending through a portion of said shaft and being in flow communication with said flange passages, thereby permitting axial movement of said sleeve relative to said cylinder upon the introduction of compressed air into said bore.

17. The device as claimed in claim 11, wherein said frame includes an aperture and said support shaft includes an inboard end extending through said aperture and a shoulder disposed adjacent said frame, and further including a pair of adjustment members positioned about said support shaft and between said shoulder and said frame, said adjustment members for adjusting the angle of said support shaft relative to said frame.

18. The device as claimed in claim 17, wherein said adjustment members are rotatable about said support shaft.

19. The device as claimed in claim 18, wherein said adjustment members are tapered washers.

20. The device as claimed in claim 18, wherein each of said washers includes a handle.

21. The device as claimed in claim 17, wherein said support shaft includes an eccentric base and said frame includes a bore, said support shaft being moveable in a direction generally perpendicular to its longitudinal axis upon rotation of said eccentric base within said bore.

22. The device as claimed in claim 21, including thrust bearings for mounting said support shaft eccentric base to said frame, said thrust bearings for preventing axial movement of said support shaft relative to said frame.

23. The device as claimed in claim 17, including adjustment means for adjusting the angle of said support shaft relative to said frame.

24. The device as claimed in claim 23, wherein said frame includes an aperture and said support shaft includes an inboard end extending through said aperture and a shoulder disposed adjacent said frame, and said adjustment means includes a pair of tapered members positioned about said shaft inboard end and between said shoulder and said frame, said adjustment members for adjusting the angle of said support shaft relative to said frame.

25. The device as claimed in claim 17, wherein said frame includes a slot and further including a carriage slidably disposed within said slot, said support shaft being mounted to said carriage, thereby permitting said support shaft to move in a direction generally perpendicular to the longitudinal axis of said support shaft.

26. An offset printing device comprising:

a frame;

a pair of support shafts, each of said support shafts having a fixed end attached to said frame and a cantilevered portion extending away from said frame, each of said support shafts further including an axial bore extending therethrough and a drive shaft extending through said axial bore, each of said drive shafts having an inboard end and an outboard end;

a hollow plate cylinder rotatably mounted to one of said support shafts and having an inner surface engaging one of said drive shaft outboard ends;

a hollow blanket cylinder rotatably mounted to the other of said support shafts and engaging the other of said drive shaft outboard ends, said blanket cylinder being generally adjacent and parallel to said plate cylinder;

a sleeve circumferentially mounted about each of said cylinders for common rotation with said cylinders;

a pair of drive motors, one of said drive motors engaging one of said drive shaft inner ends and the other of said drive motors engaging the other of said drive shaft inner ends; and a servo-controller operatively connected to each of said drive motors.

27. The device as claimed in claim 26, wherein each of said cylinders includes an internal driven portion and each of said support shafts includes a drive shaft extending though said axial bore, one of said drive shafts engaging said plate cylinder driven portion and the other of said drive shafts engaging said blanket cylinder driven portion.

28. The device as claimed in claim 26, wherein said frame includes a pair of apertures and each of said support shafts includes an inboard end extending through an adjacent one of said apertures, each of said support shafts further including a shoulder abutting said frame and a pair of adjustment members positioned about said support shafts between said shoulders and said frame, said adjustment members for adjusting the angle of each said support shafts relative to said frame.

29. The device as claimed in claim 28, wherein said adjustment members are rotatable about said support shaft.

30. The device as claimed in claim 29, wherein said adjustment members are tapered washers.

31. The device as claimed in claim 26, wherein one of said support shafts includes an eccentric base and said frame includes a bore, said one support shaft being moveable in a direction generally perpendicular to its longitudinal axis upon rotation of said eccentric base within said bore.

32. The device as claimed in claim 31, including thrust bearings for mounting said support shaft eccentric base to said frame, said thrust bearings for preventing axial movement of said support shaft relative to said frame.

33. The device as claimed in claim 32, wherein each of said drive shaft outboard ends includes a flange, each of said flanges being mounted to said driven portion of its adjacent cylinder.

34. The device as claimed in claim 33, wherein each said drive shaft outboard end includes an air passage extending axially therethrough and each said cylinder includes an outer surface having a plurality of circumferentially spaced ports in flow communication with said air passages.

35. The device as claimed in claim 34, wherein each of said flanges include a plurality of radially extending passage in alignment with said ports of its adjacent cylinder.

36. The device as claimed in claim 26, including adjustment means engaging each of said support shafts for independently adjusting the angle of each said support shafts relative to said frame.

37. The device as claimed in claim 36, wherein said frame includes an aperture and one of said support shafts includes an inboard end extending through said aperture, and wherein said adjustment means includes a shoulder disposed adjacent said frame and a pair of tapered members positioned about said shaft inboard end and between said shoulder and said frame.

38. The device as claimed in claim 26, wherein said frame includes a slot and further including a carriage slidably disposed within said slot, one of said support shafts being mounted to said carriage, thereby permitting said support shaft to move in a direction generally perpendicular to the longitudinal axis of said support shaft.

* * * * *